US006309251B1

(12) United States Patent
Tang

(10) Patent No.: US 6,309,251 B1
(45) Date of Patent: Oct. 30, 2001

(54) AUTO-SEIZING COAXIAL CABLE PORT FOR AN ELECTRICAL DEVICE

(75) Inventor: Danny Q. Tang, Manalapan, NJ (US)

(73) Assignee: Antronix, Inc., Cranbury, NJ (US)

( * ) Notice: Subject to any disclaimer, the term of this patent is extended or adjusted under 35 U.S.C. 154(b) by 0 days.

(21) Appl. No.: 09/584,995

(22) Filed: Jun. 1, 2000

(51) Int. Cl.[7] ..... H01R 9/05
(52) U.S. Cl. ..... 439/584; 439/578; 439/263
(58) Field of Search ..... 439/578–585, 439/607, 263; 339/177

(56) References Cited

U.S. PATENT DOCUMENTS

| | | | | |
|---|---|---|---|---|
| 3,686,623 | | 8/1972 | Nijman | 339/177 |
| 3,744,011 | * | 7/1973 | Blanchenot | 439/584 |
| 3,761,870 | | 9/1973 | Drezin et al. | 339/177 |
| 3,846,738 | * | 11/1974 | Nepovim | 339/177 |
| 3,854,789 | | 12/1974 | Kaplan | 339/177 R |
| 3,989,333 | * | 11/1976 | Cauldwell | 339/177 |
| 4,226,495 | * | 10/1980 | Palle et al. | 339/177 |
| 4,346,958 | | 8/1982 | Blanchard | 339/177 |
| 4,447,107 | | 5/1984 | Major, Jr. | 339/171 E |
| 4,676,577 | | 6/1987 | Szegda | 339/177 R |
| 4,854,893 | * | 8/1989 | Morris | 439/578 |
| 5,352,134 | * | 10/1994 | Jacobsen et al. | 439/584 |
| 5,586,910 | * | 12/1996 | Del Negro | 439/584 |
| 5,609,501 | * | 3/1997 | McMills et al. | 439/578 |
| 5,651,698 | * | 7/1997 | Locati et al. | 439/578 |
| 6,019,636 | * | 2/2000 | Langham | 439/584 |
| 6,027,373 | * | 2/2000 | Gray et al. | 439/578 |
| 6,102,738 | * | 8/2000 | Macek et al. | 439/584 |
| 6,129,597 | * | 10/2000 | Gresko | 439/583 |

FOREIGN PATENT DOCUMENTS

| | | | | |
|---|---|---|---|---|
| 1132215 | * | 9/1982 | (CA) | 439/584 |
| 2415590 | * | 10/1974 | (DE) | 439/584 |
| 2252458 | * | 8/1998 | (GB) | 439/584 |

* cited by examiner

*Primary Examiner*—Paula Bradley
*Assistant Examiner*—Larisa Tsukerman
(74) *Attorney, Agent, or Firm*—Kenneth Watov; Watov & Kipnes, P.C.

(57) ABSTRACT

A connecting port assembly of an electrical device comprises an internally threaded female port formed from a portion of a housing of an electrical device, where the female port is configured for threaded engagement with an externally threaded male coaxial cable connecting element. The connecting port assembly further comprises a seizure pin located within the female port where the seizure pin includes at one end a plurality of radially spaced-apart arcuate blades extending toward an opening of the female port with the blades being configured for therebetween receiving, mechanically retaining and electrically contacting a center conductor of the connecting element, and at another end being electrically connected to electrical circuitry located in other portions of the housing, and a collar assembly located around the plurality of blades within the female port, the collar assembly being configured to exert a radially inward compressive force around the plurality of blades for effecting contact and retainment by the plurality of blades with the center conductor in response to the advancement of an end portion of the connecting element into the female port.

18 Claims, 12 Drawing Sheets

AUTO-SEIZING COAXIAL CABLE PORT FOR AN ELECTRICAL DEVICE

FIELD OF THE INVENTION

The present invention relates generally to connecting ports of electrical devices, and more particularly to connecting ports of cable television and RF signal distribution equipment for coupling with hardline coaxial cables.

BACKGROUND OF THE INVENTION

In wired telecommunication systems such as in cable television, coaxial cables are typically utilized for transmitting electronic signals across a distance between two fixed points. To build a network of such cables, it is desirable to possess an efficient and effective means for coupling coaxial cables with other devices such as other pieces of cable, signal conditioners, receivers, encoders/decoders, amplifiers, splitters, multitaps, and junction boxes which may be located at either end of a run of a coaxial cable or at any other location therebetween. It is even more critical to provide a reliable and effective mechanical and electrical connection between the cable and the corresponding electrical device so that there is little impedance mismatch and signal attenuation or loss caused by the connection therebetween, and that there is little radio frequency interference from the outside or signal leakage from the inside to the outside.

The typical electrical device used in coaxial cable systems includes an electrically grounded chassis with one or more female input and/or output ports extending therefrom. Each of the female ports further includes a coupling assembly with one end electrically connected to internal circuitry housed within the chassis and the other end having a seizing mechanism for receiving and retaining an end of a coaxial cable which when properly connected, electrical engagement is made between a center conductor of the cable with the internal circuitry housed inside the chassis.

A reliable way to couple a coaxial pin connector to a connecting port for a device is desired for devices such as those mounted on top of utility poles, or in other inaccessible areas. Such devices are typically subject to temperature extremes, making reliability and ease of use essential.

In the prior art, to install a pin connector into device, an installer first tightens a connector to each of the input and output ports of the device, respectively, and then secures each connector pin of a respective connector with a seizure screw located in the associated port. Often the pin is scored or bent by the force of the seizure screw, causing physical damage to the pin. The pin is weakened, and the plating on the pin deteriorates. Also, the electrical connection is mainly with the small area of the screw, and the seizure block. Usually the device is prepared at ground level for attachment of the pin connectors at the input and output ports. Thereafter, the device with pin connectors is installed near the top of a utility pole. Next the input and output coaxial cable ends are secured to the pin connectors at the input and output ports, respectively, of the device by locking nuts on each connector. Usually, when the cables are so secured, the tightening process causes the pins of the connectors to undergo excessive torque, twisting the respective seizure assembly, and often damaging the associated assembly.

One example of the electrical device described above, is a multi-tap device, or simply multi-tap. Multi-taps are used primarily in cable television systems to tap off RF signals and AC power from a main distribution cable for bringing television or RF signals to multiple subscribers through secondary coaxial drops. The multi-tap permits connection to the main RF signal carrying cable, and provides multiple outputs for individual connection to a number of subscribers, respectively. During installation, it is a common practice to pass the main cable into one multi-tap at a female input port thereof, and to continue the main cable from a female output of the multi-tap for connecting the input port of a next multi-tap down line and so on.

In the past, coaxial cables were simply coupled to the female ports by inserting the center conductor or a pin of an associated connector into a receiving slot of the seizing mechanism where a retaining screw is tightened onto the conductor for mechanical retainment and electrical connection thereto. In response to increased telecommunication subscriberships as well as robust demand for larger bandwidths, coaxial cables particularly the center conductor portions have become progressively larger. The increased diameter of coaxial cables has led to the use of male coaxial cable connectors with center pins compatible with seizing mechanisms of the corresponding electrical devices for accommodating the larger size center conductors and cables, and providing a means for connecting ever increasing diameter coaxial cables to already existing female ports of the electrical devices including multi-taps.

The prior art seizing mechanisms suffer from serious drawbacks which limit the effectiveness of the mechanical retainment and electrical connection with the center conductor of the coaxial cable or the center pin of the male coaxial connector. Sometimes, the installer through improper installment procedures, may tighten the retaining screw within the seizing mechanism prior to tightening the coupling between the connector and the female port. When the installer subsequently applies torque to the connector to install an external coaxial cable, excessive twisting force is transferred to the center pin where either the center pin fails or the seizing mechanism is damaged. Temperature effects may also contribute to failure, whereby as the temperature changes, the center pin elongates in response to heat or contracts in response to cold. The stress associated by such physical changes as the center pin is rigidly held by the retaining screw can lead to compromised electrical contact and even complete failure.

For the foregoing reasons, there is a need for an improved female connecting port assembly of an electrical device, that can overcome all of the limitations described above in a cost effective and efficient manner. One benefit of such a connecting port is that it can provide electrical connection with a range of center pins or conductors of varying industry-accepted tolerances thereby minimizing damage to the connecting port assembly and/or to the center pin or conductor. This further enables the connecting port assembly to accommodate any physical changes in the center pin whether induced by the material, the temperature or the installer. Furthermore, the resulting contact between the connecting port and the center pin provides for a much improved connection with better electrical signal quality and reliability.

SUMMARY OF THE INVENTION

With the problems of the prior art in mind, an object of the present invention is to overcome these problems.

The present invention is generally directed to a female connecting port assembly of a electrical device, which is cost efficient, easy to fabricate and implement, and is adapted for connecting with a coaxial cable in a manner which provides the benefits of ease of implementation and reliable mechanical retainment and electrical connection, concurrent with the flexibility of accommodating a range of pin sizes over varying operating conditions including temperature. The port assembly generally comprises a port formed from a housing of the electrical device, and means for mechanically retaining and electrically connecting a center pin of a male coaxial cable connector to internal electrical circuitry located within the electrical device housing.

In particular, one aspect of the present invention is directed to a female connecting port assembly of an electrical device in which the assembly comprises:

a female port formed from a portion of a housing of the electrical device, the female port being configured for mechanical retainment and electrical connection with a coaxial cable connecting element;

a seizure member located within the female port, the seizure member having one end electrically coupled to electrical circuitry located in other portion of the housing, the seizure member being configured at another end for receiving, mechanically retaining and electrically contacting a center pin of a coaxial cable connector; and an actuating assembly being configured for effecting mechanical retainment and electrical contact of the seizure member to the center conductor in response to advancement of an end portion of the coaxial cable connecting element into the female port during connection and retainment therebetween, the actuating assembly including a contact pressure restricter for limiting excessive contact pressure exerted by the seizure member on the center conductor.

In another aspect of the present invention, the female connecting port assembly comprises:

an internally threaded female port formed from a portion of a housing of an electrical device, the female port being configured for threaded engagement with an externally threaded male coaxial cable connecting element;

a seizure pin located within the female port, the seizure pin including at one end a plurality of radially spaced-apart arcuate blades extending toward an opening of the female port, the blades being configured for therebetween receiving, mechanically retaining and electrically contacting a center conductor of the connecting element, and at another end being electrically connected to electrical circuitry located in other portions of the housing; and a collar assembly located around the plurality of blades within the female port, the collar assembly being configured to exert a radially inward compressive force around the plurality of blades for effecting contact and retainment by the plurality of blades with the center conductor in response to the advancement of an end portion of the connecting element into the female port.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is generally directed to a female connecting port assembly of an electrical device constructed in a manner that provides long-term reliability and effectiveness in maintaining mechanical and electrical connection for conducting energy, i.e. RF signal and AC power between an internal circuitry of the electrical device and a corresponding coaxial cable coupled directly, or indirectly, through a male connector. The connecting port assembly is constructed with the advantage of accommodating a range of male connector center pin sizes, over a range of operating temperatures with little degradation in electrical connection reliability and RF signal quality. In addition, compared to the prior art, the connecting port assembly of the present invention substantially simplifies the installation and implementation of the connection between the associated electrical device and the coaxial cable thus minimizing potential occurrences of line failure, breakdown or outage of the electrical connection. The cost efficient and effective manner by which these port assemblies are constructed and by which the individual connecting port assembly can be implemented for electrically connecting coaxial cables to electrical devices makes such port assemblies especially suitable for telecommunication use.

Figure 1:
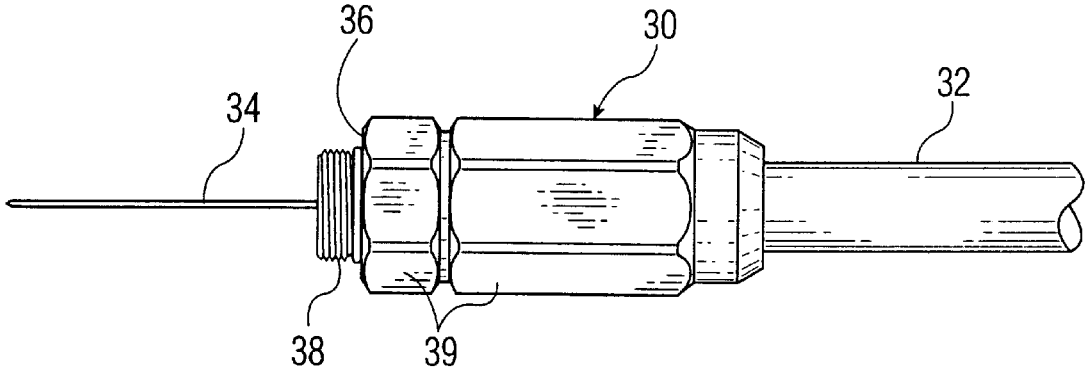
FIG. 1 PRIOR ART
FIG. 1 is a side elevational view of a male coaxial cable connector of the prior art mounted onto a coaxial cable.

Referring to FIG. 1, a typical male coaxial cable connector 30 mounted at the end of a coaxial cable 32 is shown. The connector 30 includes an electrically conductive center pin 34 in electrical contact with a center conductor (not shown) of the coaxial cable 32, and an outer housing 36 being insulated from the center pin 34 and in electrical contact with a coaxial cable shield (not shown). The connector 30 may further include external threads 38 extending along the end of the outer housing 36 proximate the center pin 34 for threaded engagement with a corresponding threaded female connecting port assembly as will be described hereinafter. The connector outer housing 36 may also include a multi-faceted surface 39 for permitting the use of a fastening tool, i.e. wrench, during securement of a connection therebetween.

Figure 2:
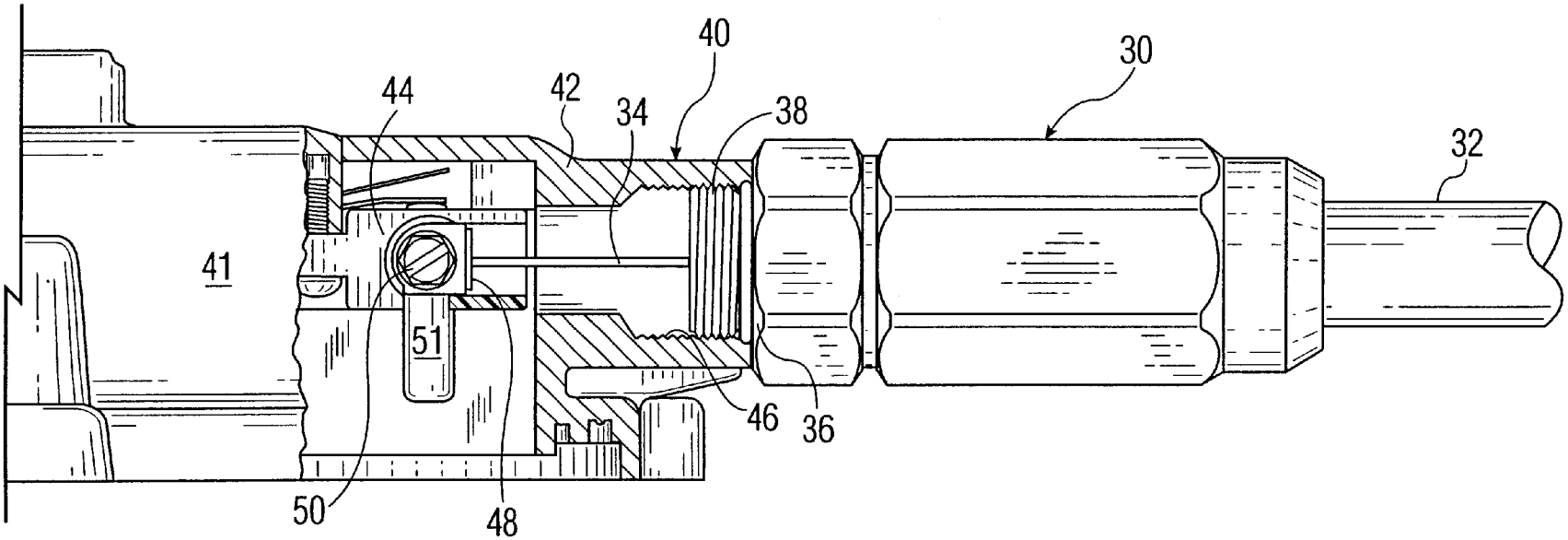
FIG. 2 PRIOR ART
FIG. 2 is a partially cutaway elevational view of a prior art female connection port assembly of an electrical device coupled to the male coaxial cable connector of FIG. 1.

Referring to FIG. 2, a partially cut-away view of a prior art female connecting port assembly 40 is shown coupled mechanically and electrically to the male connector 30 and the coaxial cable 32. The port assembly 40 is part of a chassis or housing 41 of an electrical device with an internal circuitry (not shown) located therein, and includes a hollow female port housing 42, a center pin seizure mechanism 44 located within the port housing section 42, and a set of internal threads 46 proximate the open end thereof. The male connector 30 is generally inserted into the port housing 42, for threaded engagement between the external threads 38 of the connector 30 and the internal threads 46 of the port assembly 40, for secure moisture proof mechanical coupling therebetween, and to provide electrical ground connection between the port housing 42 and the connector housing 36. Correspondingly, the center pin 34 is inserted into a receiving slot 48 in the seizure mechanism 44. A retaining screw 50 is provided at the receiving slot 48 for mechanically retaining and electrically connecting the center pin 34 with the internal circuitry (not shown) upon secure fastening thereof. A conducting pin 51 extends from the seizure mechanism 44 for providing an electrical lead to the internal circuitry (not shown).

With this configuration, the center pin 34 of the connector 30 is rigidly retained in the receiving slot 48 by the retaining screw 50, and the resulting electrical connection and parts are fixed and firmly held in position. This arrangement makes the connection susceptible to connection failure problems. Over a course of operation, the port assembly 40 and the center pin 34 may be exposed to temperature changes which can cause the associated parts to expand or contract at different rates resulting in mechanical stress and fatigue. This cycling of the physical stress over time can diminish the quality of the electrical contact and may even cause physical deformation and deterioration that could lead to fractures and connection failures.

Mistakes made during the course of installation may also result in significant damage and connection failure. During connection, the connector 30 is preferably tightened to the port housing 42 prior to fastening the retaining screw 50 to the center pin 34. If the order of the connection procedure is reversed, the subsequent tightening of the connector 30 may impart excessive torque stress on the fixed center pin 34 and seizure mechanism 44 which could lead to breakage and failure of the mechanical and electrical connection. Conversely, if the connection is released, damage may also occur where the center pin 34 is inadvertently left fastened during disengagement of the connector 30.

Figure 3:
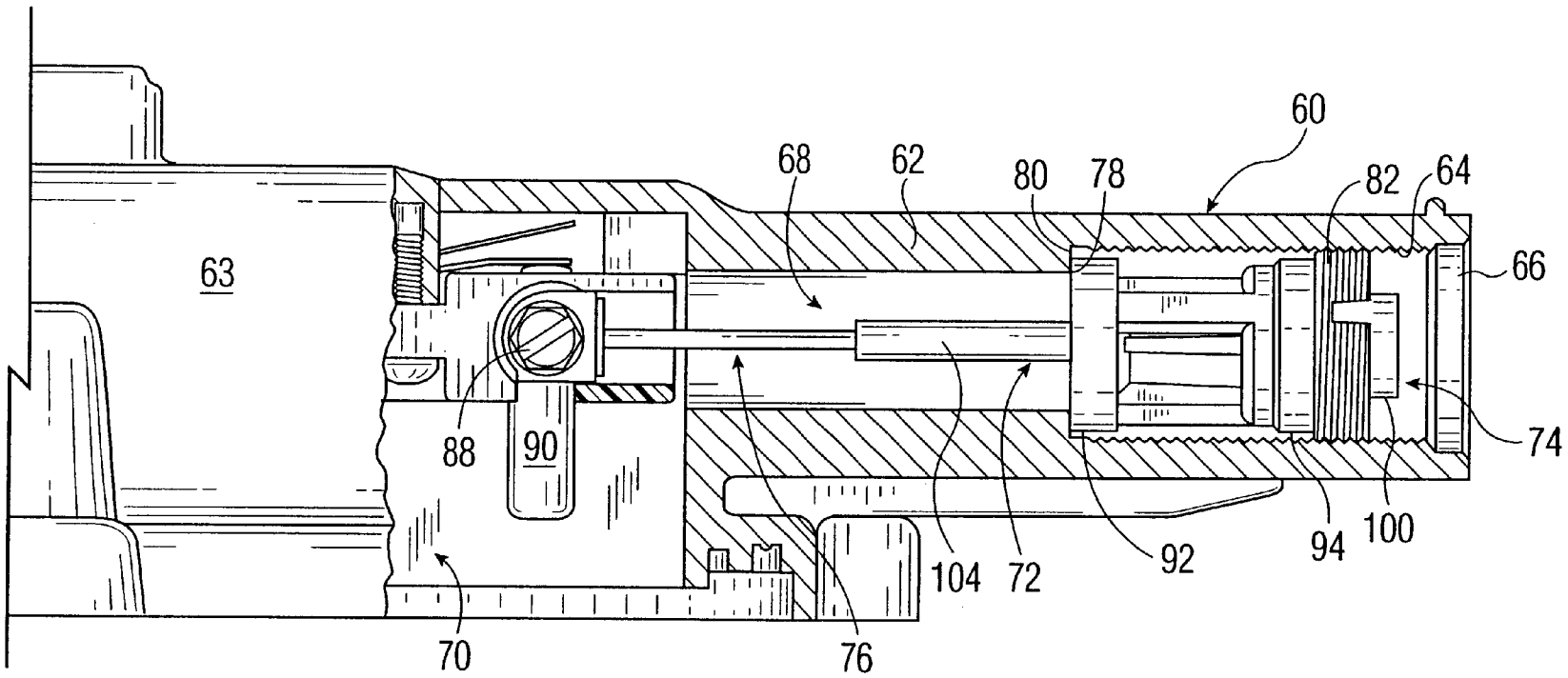
FIG. 3 is a partially cutaway elevational view of a female connecting port assembly for one embodiment of the present invention.
Figure 4:
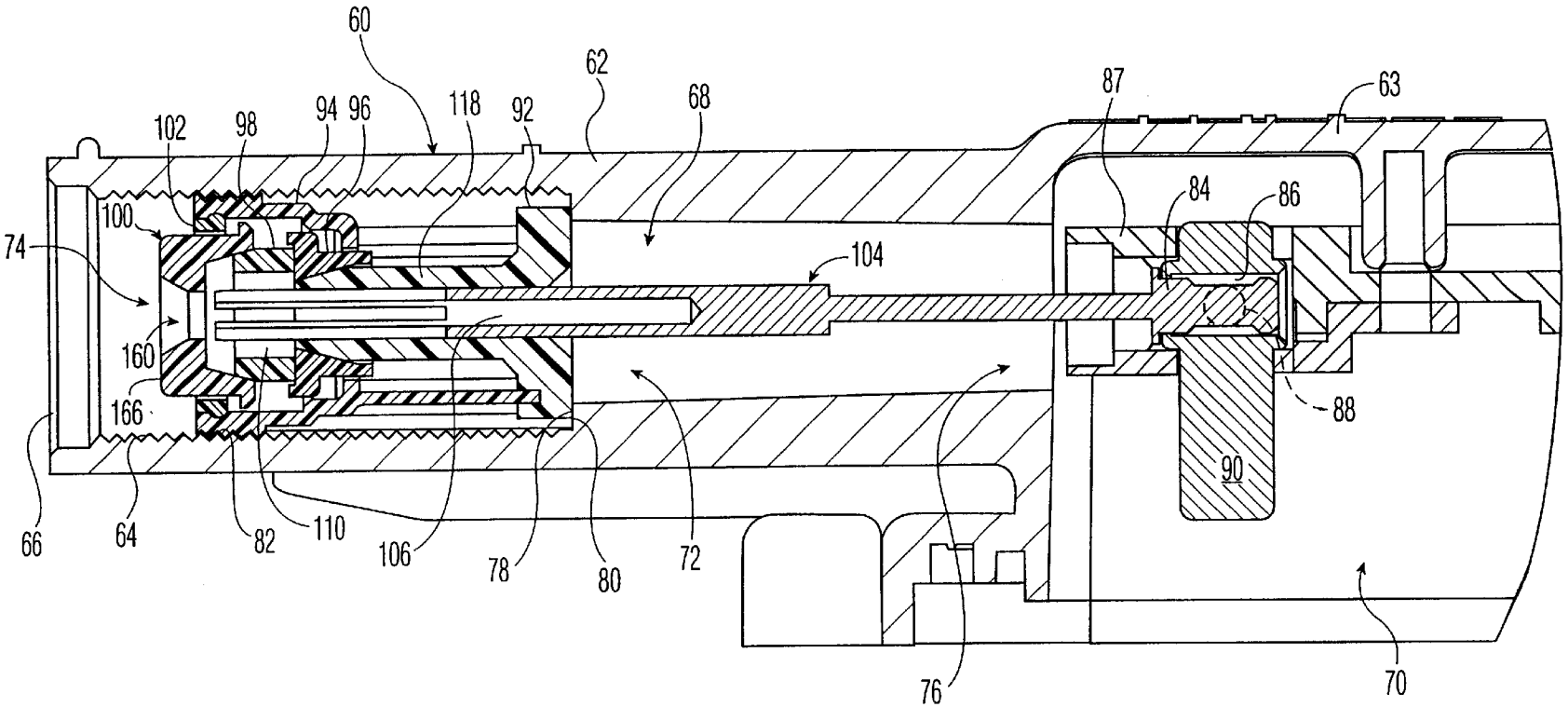
FIG. 4 is a longitudinal cross sectional view of the connecting port assembly of FIG. 3 rotated 180°.

Referring now to FIGS. 3 and 4 which illustrate one embodiment of a female connecting port assembly in accordance with the present invention and which is particularly useful for attachment to a connecting end of a male coaxial cable connector or to an end portion of a coaxial cable. The specific structure and arrangement of elements of the port assembly insures low electrical and/or signal losses, and thus provide for highly efficient transfer of energy between a coaxial cable and associated electrical/electronic components. The port assembly of FIG. 3 is generally denoted by the reference numeral 60, and includes a hollow female port housing 62, and a set of internal threads 64. Note that a given electrical device may include at least a plurality of port assemblies 60 for multiple inputs and/or outputs, respectively, as may be required for a given application.

The hollow female port housing 62 is part of a greater metal wall of a chassis or other housing 63 of an electrical device which is to be connected to a coaxial cable, and is preferably grounded for providing continuous shielding of the RF signal and AC power transmitted between the coaxial cable and the associated electrical/electronic components housed within the electrical device. The port housing 62 and chassis 63 are preferably fabricated from a metal material including, but not limited to, brass, copper, aluminum, combinations of metals, and so forth. The length of the female port housing 62 and the size of the internal components contained therein may vary, as desired, depending on the application and the specification required for installation and implementation of the invention.

The term "electrical device" as used herein includes, but is not limited to, other portions of coaxial cable, multi-taps, signal conditioners, receivers, encoders/decoders, amplifiers, splitters, junction boxes and the like which may be located at either end of a run of a coaxial cable or at any other location therebetween.

The term "multi-tap" as used hereinafter refers generally to an electrical device used in the cable television and other RF distribution systems where it is necessary to tap off an RF signal and AC power (if any) from a main distribution cable for transmitting such RF signal to multiple subscribers on a secondary cable. The multi-tap permits connection to the main RF signal distribution cable, and provides multiple outputs for individual connection to a number of subscribers, respectively, and AC power to the subscriber device.

The hollow female port housing 62 includes an opening 66 for receiving the male connector 30 therethrough, and a cavity 68 in communication with the opening 66 and an interior volume 70 of the electrical device at the interior end thereof The port assembly 60 further includes a center pin seizure mechanism 72 located within the cavity 68 of the female port housing 62. The seizure mechanism 72 includes a first end 74 for receiving, electrically connecting and mechanically retaining the center pin 34 (see FIG. 1) of a cable connector 30 (see FIG. 1) as will be described, and a second end 76 for electrically conducting the RF signal and power transmitted between the retained center pin 34 and the internal circuitry or electrical/electronic components located within the interior volume 70.

The first end 74 of the seizure mechanism 72 includes generally a corner base portion 78 which abuts an internal stepped ledge portion 80 of the port housing 62, and a threaded portion 82 which is threadedly engaged with the internal threads 64 proximate the opening 66 of the port housing 62. The corner base portion 78 and the threaded portion 82, in combination with the port housing 62, maintain the fixed position of the seizure mechanism 72 within the cavity 68 and prevent any longitudinal movement thereof. The second end 76 includes a knob-like portion 84 located within a retaining slot 86 (see FIG. 4) of a retainer element 87. A contact screw 88 is provided in the retaining slot 86 for retaining and fastening against the knob-like portion 84. In a preferred embodiment, the knob-like portion 84 is soldered into retaining slot 86. Upon securement, the knob-like portion 84 remains fixed therein and is electrically connected with an electrically conducting pin 90. The conducting pin 90 may be electrically connected to the associated electrical/electronic components/circuitry housed within the interior volume 70.

The seizure mechanism 72 further comprises a combination of interacting parts which cooperate to perform the functions of receiving, mechanically retaining and electrically connecting the center pin 34 of a male connector 30 (see FIG. 1) to the electrical device as will be described. More specifically, as shown in FIGS. 3 and 4, the seizure mechanism 72 comprises a compression collar 92, a retainer housing 94, a lower compression cap 96, a compression ring 98, an upper compression cap 100, a retainer locking ring 102, and a seizure pin 104. As best shown in FIG. 4, a central longitudinal passage 106 formed by the associated components of the seizure mechanism 72 extends through the first end 74 of the seizure mechanism 72. The passage 106 is adapted to receive the center pin 34 of the male connector 30 through an opening 160 therein upon coupling of the connector 30 to the female port housing 62. The length of the central passage 106 is preferably selected to accommodate the length of the coupled center pin 34 including varying industry-accepted manufacturing tolerances and any length changes induced by temperature gradients. It is further noted that the seizure mechanism 72 is adapted to accommodate varying center pin diameters effectuated by manufacturing tolerances as well as temperature variances as will be described.

The seizure pin 104 is composed generally of an electrically conductive metal material for providing an electrical connection between the center conductor of the coaxial cable via pin 34, and the electrical/electronic components within the interior volume 70. Such metal material includes, but is not limited to, brass, copper, aluminum, combinations of metals, and so forth. The remaining components of the seizure mechanism 72 are composed of a durable, resilient insulating material such as DELRAN®, or other suitable plastic materials and other materials of like properties for electrically insulating the center pin 34 and the seizure pin 104 from the electrically ground female port housing 62.

Figure 5:
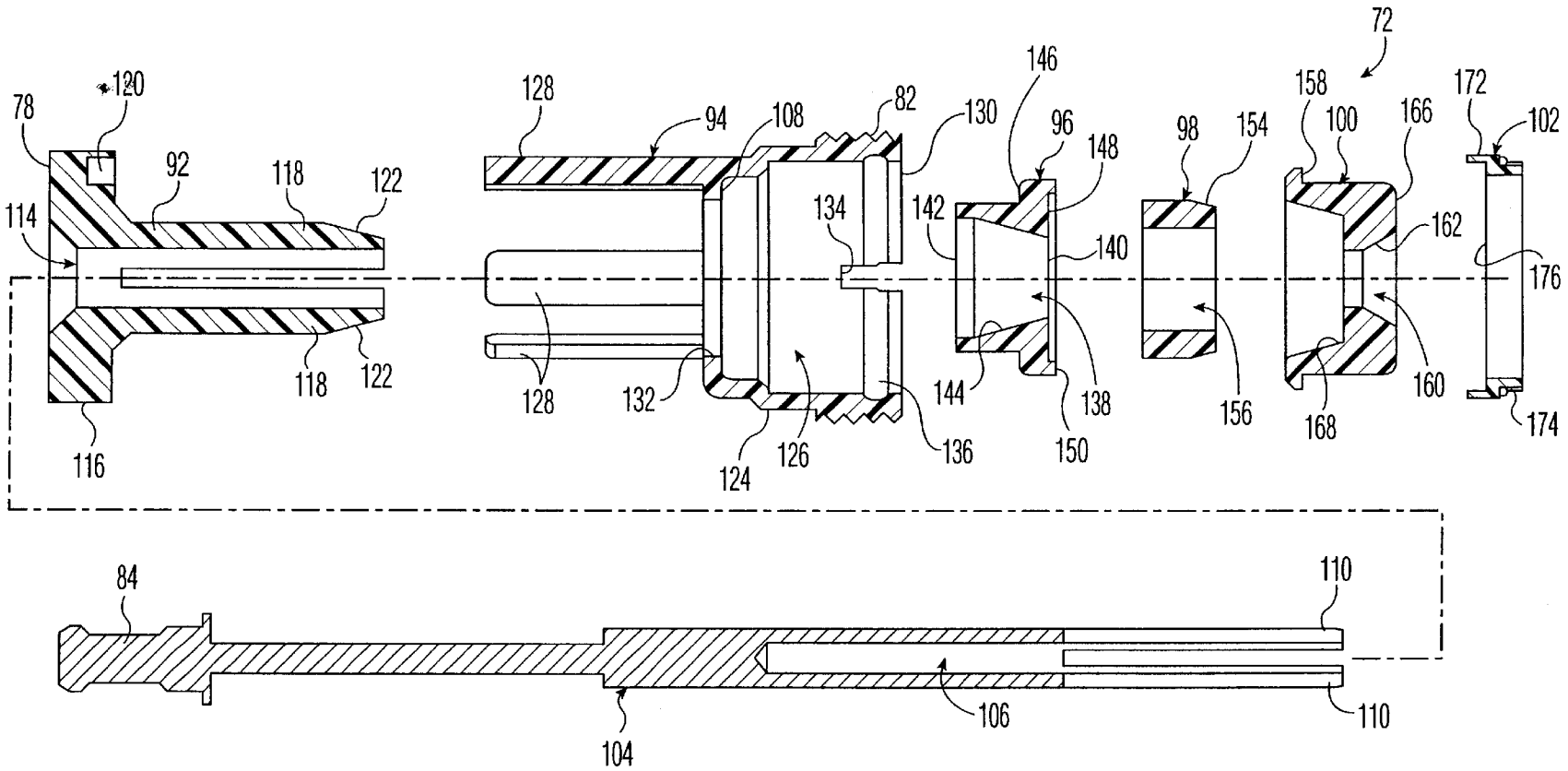
FIG. 5 is an exploded cross sectional assembly view of a seizure mechanism of the connecting port shown in FIG. 3.
Figure 6:
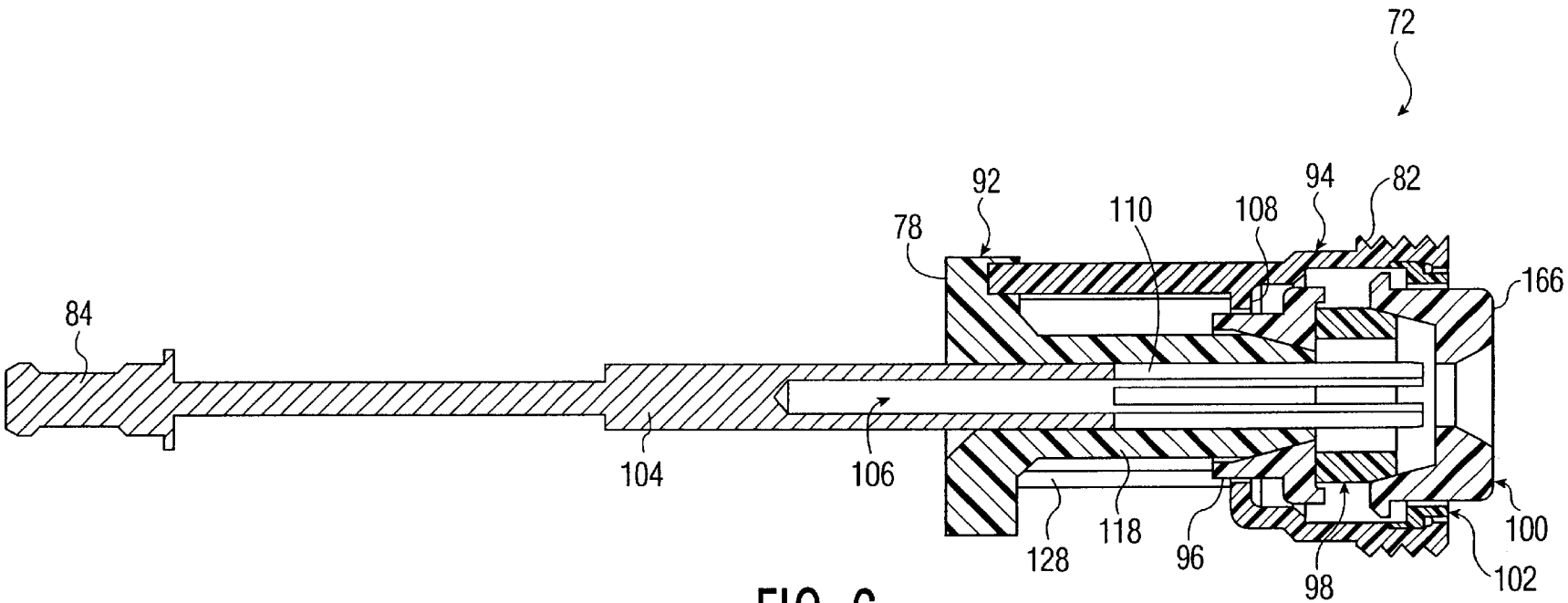
FIG. 6 is a cross sectional elevational view of the seizure mechanism of FIG. 5.

With reference to FIGS. 5 and 6, an exploded assembly cross sectional view and an assembled cross sectional view of the seizure mechanism 72, respectively, are shown for a detailed layout. The seizure pin 104 is pushed into port housing 62 (see FIG. 4) through the opening 66 into the cavity 68 with the knob-like portion 84 entering first. The knob-like portion 84 is secured in the retaining slot 86 of the retainer element 87. Next, the retainer collar 92 is coupled to the retainer housing 94. The retainer collar 92 provides the base support and in combination with the retainer housing 94, serves to provide centralized positioning for the seizure pin 104 within the port housing 62.

The lower compression cap 96 is seated on an end portion 122 of the retainer collar 92. Next, the compression ring 98 is seated at one end on a recessed top surface 148 of the lower compression cap 96. The upper compression cap 100 is slipped over the compression ring 98 to seat an interior converging sidewall 168 of cap 100 on exterior converging sidewall 154 of ring 98. Once the lower compression cap 96, the compression ring 98, and the upper compression cap 100 are properly positioned within the retainer housing 94, the retainer locking ring 102 is mated in locking engagement with the retainer housing 94 for holding the assembly therein. In this arrangement, the lower compression cap 96, the compression ring 98, and the upper compression cap 100 are configured for longitudinal sliding movement within the retainer housing 94 when force is applied to the upper compression cap 100 as will be described. Note that the retainer housing 94 includes a ledge portion 108 for limiting the longitudinal sliding movement of the retained assembly. Lastly, the retainer collar and housing assembly is threadedly fastened to the port housing 62 until the corner portion 78 of the retainer collar 92 abuts the stepped ledge portion 80 of the port housing 62 (see FIG. 4) for secure and rigid retension therein.

Figure 7:
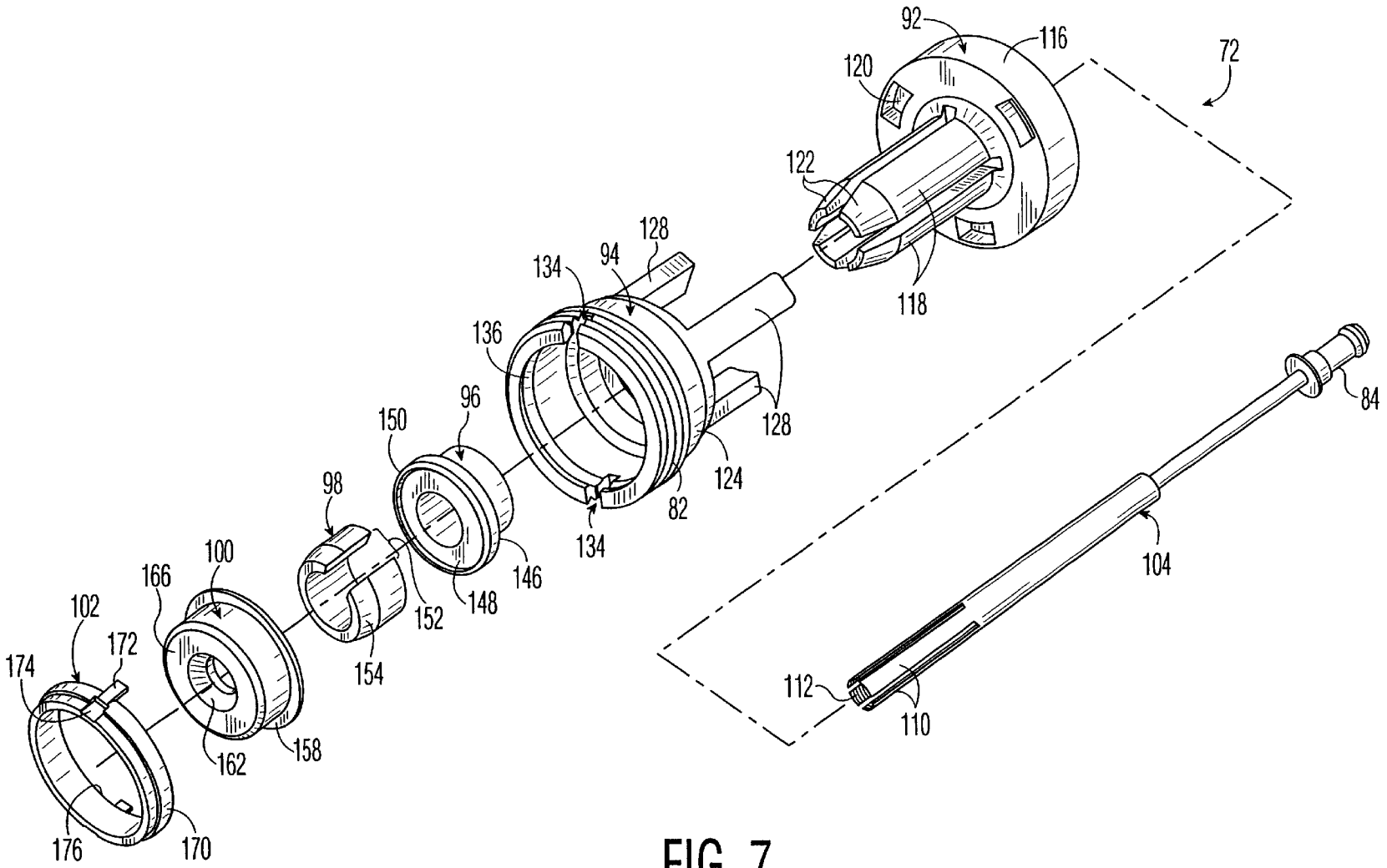
FIG. 7 is an exploded pictorial assembly view of the seizure mechanism of FIG. 5.

With reference to FIG. 7, an exploded assembly diagram is shown of the seizure mechanism 72.

Figure 8:
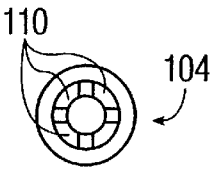
FIG. 8 is an end view of a seizure pin of the seizure mechanism.
Figure 12:
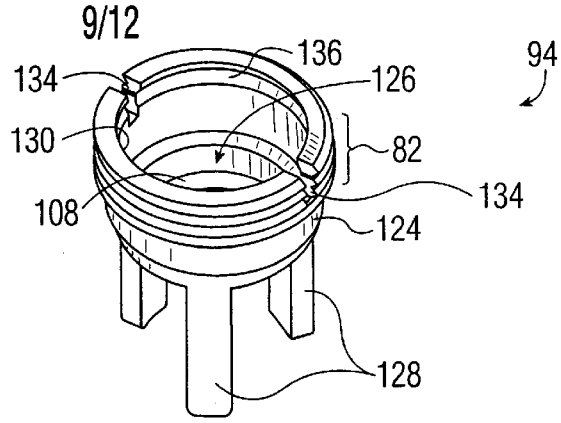
FIG. 12 is a top pictorial view of a retainer housing of the seizure mechanism.
Figure 13:
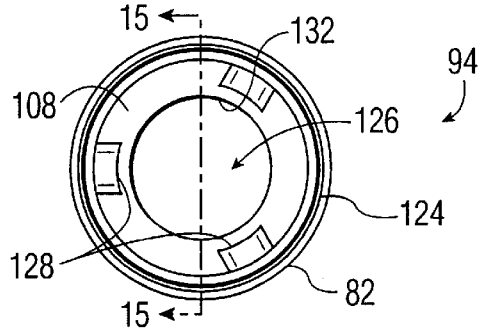
FIG. 13 is a bottom plan view of the retainer housing of FIG. 12.
Figure 14:
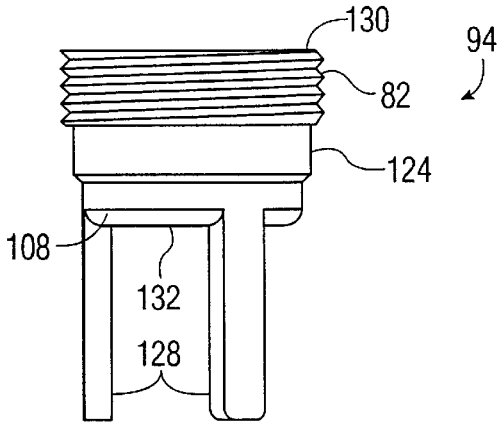
FIG. 14 is a side elevational view of the retainer housing of FIG. 12.
Figure 15:
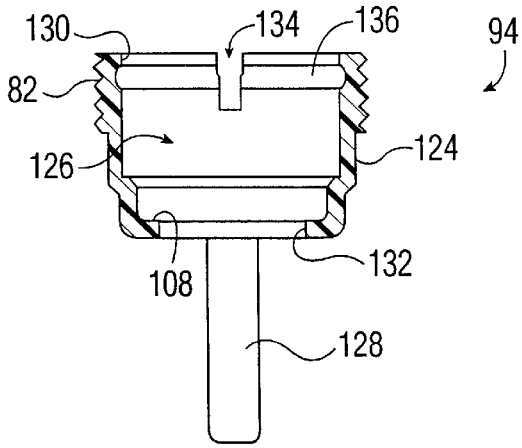
FIG. 15 is a cross sectional elevational view of the retainer housing taken along 15—15 of FIG. 13.

Referring to FIGS. 5, 7 and 8, the design of the seizure pin 104 is shown. The knob-like portion 84 is located at one end, and at the other end, the seizure pin 104 includes a plurality of radially spaced-apart arcuate blades 110. The blades 110 are configured to bend and flex radially inward when a circumferential inward directed force is applied externally thereto, for inducing contact with the surface of the center pin 34 during coupling as will be described. The arcuate shape of the blades 110 provides an optimal contact surface area around the substantially cylindrical center pin 34 of the male connector 30. When the circumferential force is relieved, the blades 110 return to their original outward non-contact positions. Each of the blades 110 may optionally include a serrated interior surface 112 (see FIG. 7) for improved clasping contact with the center pin 34 during coupling.

Figure 11:
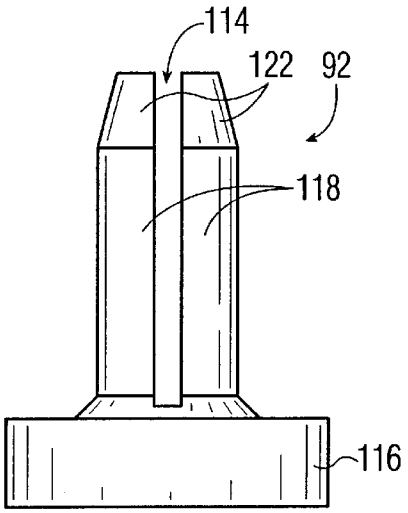
FIG. 11 is a side elevational view of the compression collar of FIG. 9.
Figure 10:
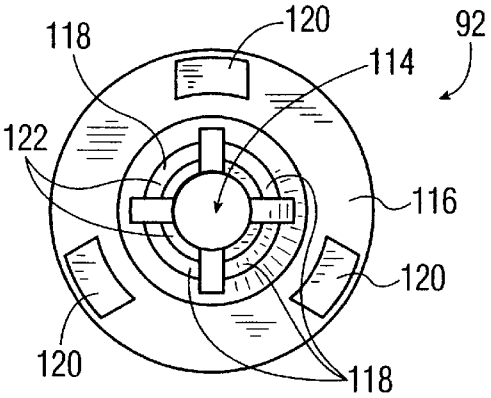
FIG. 10 is a top plan view of the compression collar of FIG. 9.
Figure 9:
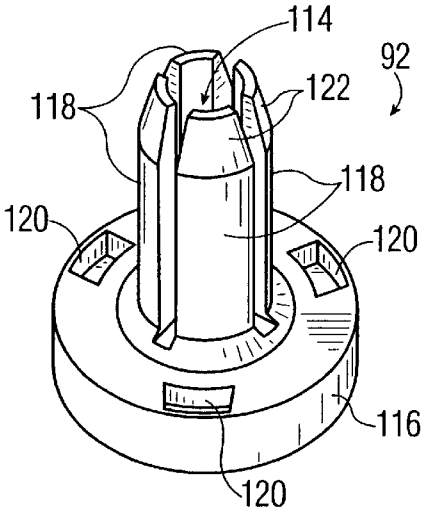
FIG. 9 is a top pictorial view of a compression collar of the seizure mechanism.

FIGS. 9, 10, and 11 show the design of the retainer collar 92. The retainer collar 92 includes a centrally located throughhole 114, a circular base 116, a plurality of spaced-apart fingers 118, and a plurality of slots 120 in the top face of the base 116. Note that each of the fingers 118 include a beveled end portion 122. The fingers 118 are configured to bend and flex radially inward when an outer circumferential force is applied thereto. The throughhole 114 permits entry of the seizure pin 104, particularly the arcuate blades 110 therethrough. The fingers 118 are configured for operative circumferential flexing engagement with the plurality of blades 110 of the seizure pin 104 as shown in FIGS. 4 and 6. The plurality of slots 120 are provided in the retaining collar's base 116 for coupling engagement with the retainer housing 94 as will be described.

FIGS. 12, 13, 14 and 15, show design details for the retainer housing 94. The retainer housing 94 includes a cylindrical body portion 124 with a hollow core 126 therein, and a set of external threads 82 for engagement with the internal threads 64 of the port housing 62 as shown in FIGS. 3 and 4. The retainer housing 94 further includes a plurality of downwardly-depending spacing legs 128, each of which are configured to be inserted into the corresponding slots 120 of the retainer collar 92 for secure coupling therebetween as shown in FIGS. 3, 4 and 6. The cylindrical body portion 124 includes an upper opening 130 and a lower opening 132 with the hollow core 126 therebetween. As noted above, the body portion 124 is provided with the ledge portion 108 extending around the lower opening 132 to limit the downward movement of the components 96, 98 and 100 retained within hollow core 126 as will be described. A pair of opposing locking slots 134 and a circumferential groove 136 extending along the inside surface, are disposed proximate the upper opening 130 for secure engagement with the locking retainer ring 102 as will be described. Alternatively, spacing legs 128 can be replaced by a cylindrical shell with the bottom portion threaded, and slots 120 can be replaced by a threaded groove for mating with the threaded portion of the cylindrical shell.

Figure 16:
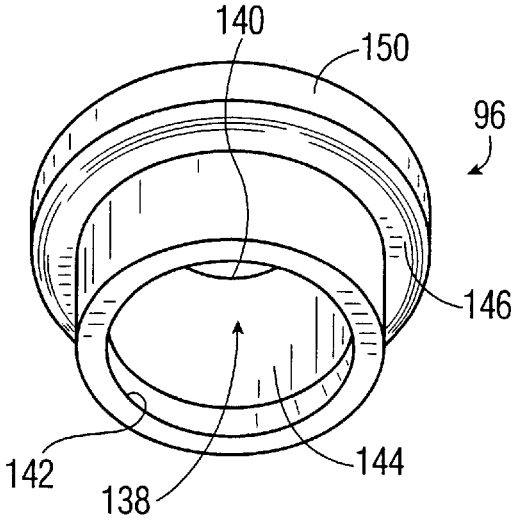
FIG. 16 is a bottom pictorial view of a lower compression cap of the seizure mechanism.
Figure 17:
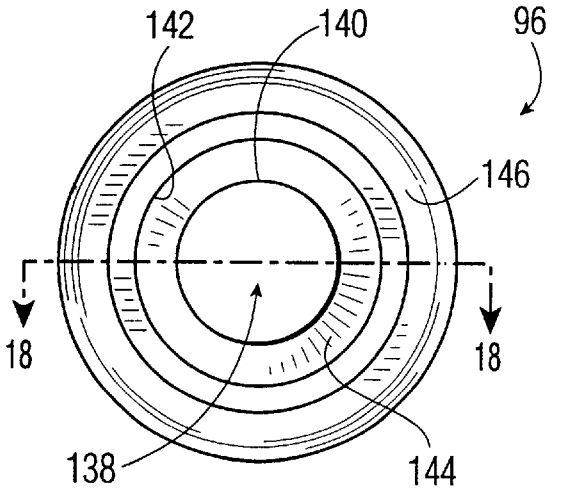
FIG. 17 is a bottom plan view of the lower compression cap of FIG. 16.
Figure 18:
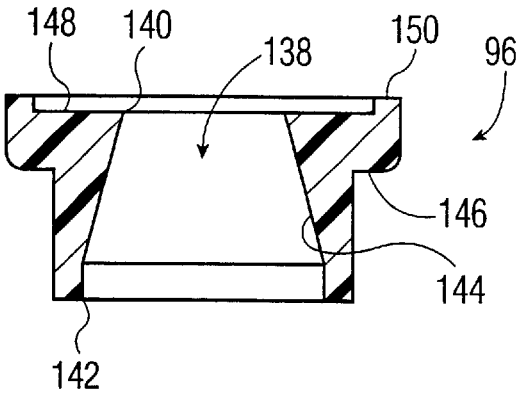
FIG. 18 is a cross sectional elevational view of the lower compression cap taken along 18—18 of FIG. 17.

Referring to FIGS. 16, 17 and 18, the lower compression cap 96 is shown in greater detail. The lower compression cap 96 includes a throughhole 138 with an upper opening 140 and a larger lower opening 142. A upwardly converging inside portion 144 extends between the lower and upper openings 142 and 140. The tapered inside portion 144 is configured to fit and operatively engage with the chamfer end portions 122 of the fingers 118 of the retainer collar 92 as best shown in FIGS. 4 and 6. With reference to FIGS. 4 and 6, as the lower compression cap 96 moves downwardly, the inside portion 144 slides along the end portions 122 of the fingers 118 of the retainer collar 92 biasing the fingers 118 radially inward, which in turn, cause the blades 110 of the seizure pin 104 to bend inward and flush against the surface of the center pin 34. In this manner, mechanical retainment and electrical contact of the center pin 34 is accomplished during coupling therebetween.

The lower compression cap 96 further includes relative to its lower portion a broader or larger diameter upper portion 146 which is configured for movement-limiting engagement with the ledge portion 108 of the retainer housing 94 to prevent over-clamping of the seizure pin 104 on the center pin 34 as will be described. A top recessed flat edge surface 148 with a upstanding flange portion 150 extending therearound, is provided for supporting the compression ring 98 thereon.

Figure 19:
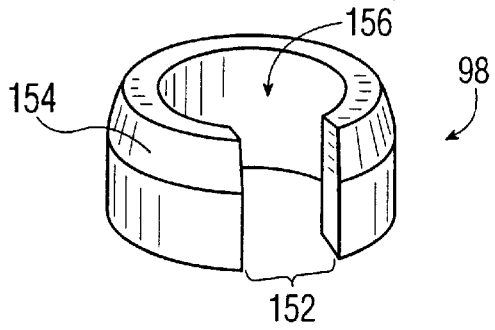
FIG. 19 is a top pictorial view of a compression ring of the seizure mechanism.

Referring to FIG. 19, the design of the compression ring 98 is shown. The substantially annular compression ring 98 includes a cleft 152, a chamfered upper side portion 154, and centrally located throughbore 156 for permitting passage of the seizure pin 104 therethrough (see FIGS. 4 and 6). In combination with the upper compression cap 100, the compression ring 98 provides a means for automatically adjusting the seizing mechanism 72 to accommodate a particular center pin 34. The cleft 152 permits the compression ring 98 to flex radially inward during coupling, when encountering excessive compressive force thereon for accommodating manufactured tolerances of the center pin 34, and the threaded portion 38 (see FIG. 1) and changes induced by varying temperature gradients as will be described.

Figure 20:
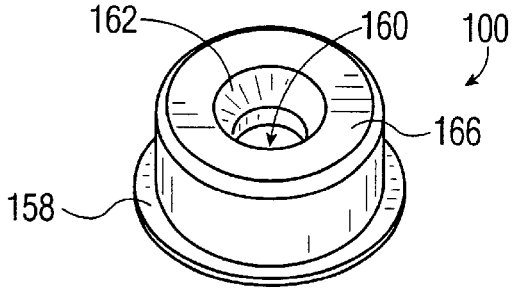
FIG. 20 is a top pictorial view of an upper compression cap of the seizure mechanism.
Figure 21:
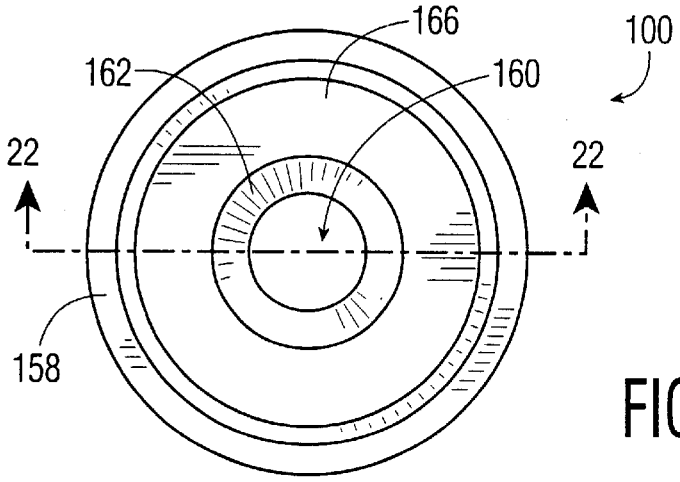
FIG. 21 is a top plan view of the upper compression cap of FIG. 20.
Figure 22:
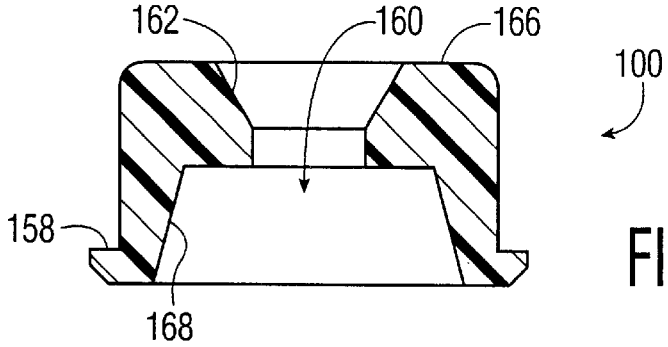
FIG. 22 is a cross sectional elevational view of the upper compression cap taken along 22—22 of FIG. 21.
Figure 23:
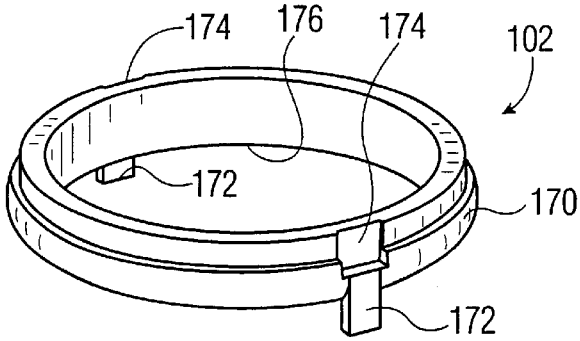
FIG. 23 is a pictorial view of a retainer locking ring of the seizure mechanism.
Figure 24:
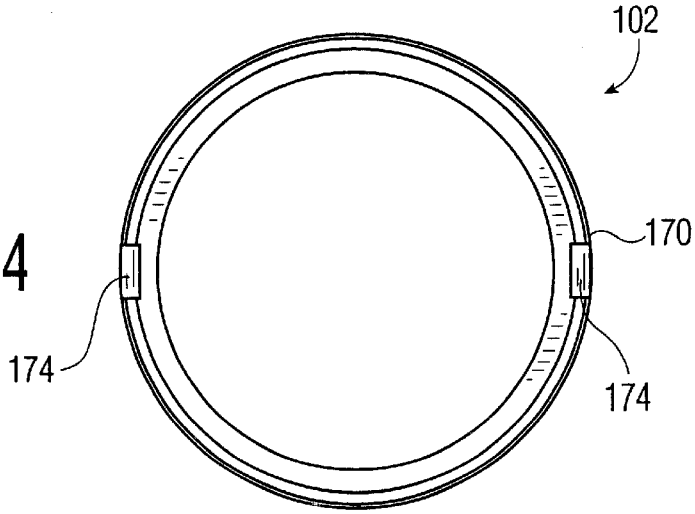
FIG. 24 is a top plan view of the retainer locking ring of FIG. 23.
Figure 25:
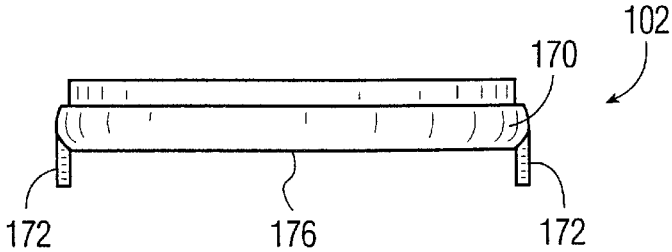
FIG. 25 is a front side elevational view of the retainer locking ring of FIG. 23.
Figure 26:
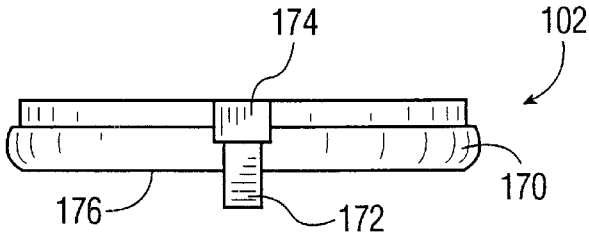
FIG. 26 is a right side elevational view of the retainer locking ring of FIG. 23.

With reference to FIGS. 20, 21 and 22, the design of the upper compression cap 100 is shown in greater detail. The upper compression cap 100 is an annular piece with a ledge portion 158 extending along the base periphery for retainment of the associated components within the retainer housing 94 as will be described hereinafter. The upper compression cap 100 further includes a throughhole 160 for permitting the center pin 34 to extend therethrough during coupling. The throughhole 160 includes a downwardly or inward converging side portion 162 for assisting the insertion of the center pin 34. A top surface 166 is provided to make contact with an end portion of the male connector 30 for imparting a compressive force thereon into the seizure mechanism 72 during coupling, thus actuating the seizure pin's contact with the center pin 34.

The throughhole 160 further includes a lower diverging side portion 168 as shown in FIG. 22. The diverging side portion 168 is adapted to fit on the upper chamfered side portion 154 of the compression ring 98 as best shown in FIGS. 4 and 6. As the upper compression cap 100 moves downwardly, it imparts a compressive force on all the components below and induces a downward movement on the components until contact between the seizure pin 104 and the center pin 34 is made. Once this point is reached, the components cannot move any further. To prevent damage to the seizure mechanism 72 or the center pin 34, the excess compressive force is then absorbed by the compression ring 98 as it travels upwardly within the lower side portion 168 while flexing radially inward. When the excess compressive force is relieved the compression ring 98 rebounds back and biases the upper compression cap 100 upwards back to the original position thereon while ensuring the seizure pin 104 remains in contact with the center pin 34.

The compression ring 98 actively adjusts the seizing mechanism 72 throughout the connection interval. When the center pin 34 expands due to heat, the excess compressive force generated is automatically relieved by the compression of the compression ring 98 as it moves into the upper compression cap 100 averting damage inducing strain in the connection. When the center pin 98 contracts in response to cold, the contact between the seizure pin 104 and the center pin 34 is maintained. The compression ring 98 under tension within the upper compression cap 100 is biased outward in response to the change in center pin diameter. The emerging compression ring 98 induces the lower compression cap 96 to slide inward causing the blades 110 to flex further radially inward to maintain constant contact with the center pin 34.

Referring to FIGS. 23, 24, 25 and 26, the design of the retainer locking ring 102 is detailed. The retainer locking ring 102 is annularly shaped and includes a circumferential projection 170 extending along the base periphery thereof, and a pair of opposing guide tabs 172 extending downwardly therefrom. The retainer locking ring 102 is configured for mating engagement with the upper opening 130 of the retainer housing 94 to retain the components 96, 98 and 100 of the seizure mechanism 72 therein. The flange portion 170 is configured for a snap-in fit into the corresponding groove 136 of the retainer housing 94 for secure retainment. The guide tabs 172 are provided for engagement with the corresponding slots 134 of the retainer housing 94 for ensuring proper alignment in the retainer housing 94. A pair of opposing recesses 174 located above the tabs 172 are provided for forming fastening slots to enable the seizing mechanism 72 to be screw-turned into the port housing 62 during assembly. A bottom edge portion 176 of the retainer locking ring 102 is configured for stopping engagement with the ledge portion 158 of the upper compression cap 100.

Note that throughout this detailed description, certain material may be called out for showing the preferred embodiments of the invention. However, any suitable material may be used for the various components or port assembly parts described in the embodiments of the invention.

With reference to FIGS. 3 through 7, the various components of the present invention as assembled will be described in greater detail. The seizure pin 104 is inserted into the port housing 62 through the opening 66 with the knob-like portion 84 end first. The knob-like portion 84 is then introduced into the retaining slot 86 of the retainer element 87 and fastened therein securely by the contact screw 88. The retainer housing 94 is coupled to the retainer collar 92 by inserting the plurality of spacing legs 128 into the corresponding collar slots 120. The lower compression cap 96 is slipped onto the beveled end portions 122 of the plurality of fingers 118 of the retainer collar 92. The compression ring 98 is placed on the top flat surface 148 between the lip 150. The upper compression cap 100 is then capped on the upper side portion 154 of the compression ring 100.

Next, the retainer locking ring 102 is snapped into the upper opening 130 of the retainer housing 94 wherein the guiding tabs 172 and the circumferential projection 170 of the ring 102 are introduced into the corresponding guiding slots 134 and the groove 136 of the retainer housing 94, respectively. The retainer locking ring 102 retains all the parts within the retainer housing 94. The retainer housing and retainer collar assembly is then inserted through the opening 66 with the retainer collar end first. The assembly is threadedly fastened into the port housing 62 until the edge portion 78 of the base 116 of the retainer collar 92 is abutting against the stepped ledge portion 80 of the port housing 62 with the arcuate blades 110 of the seizure pin 104 extending through the center thereof as best shown in FIGS. 4 and 6.

With reference to FIGS. 3 through 24, the overall operation of the port assembly 60 will be described in detail. The connector 30 with the center pin 34 is introduced into the port housing 62 through the opening 66. The center pin 34 enters through the opening 108 of the seizure mechanism 72 into the central channel 106 within the seizure pin 104. While the connector 30 is being threadedly fastened into the port housing 62, the end of the connector 30 contacts and presses against the top surface 166 of the upper compression cap 100. The pressure biases the upper compression cap 100, the compression ring 98, and the lower compression cap 96 inward into the seizure mechanism 72. As the lower compression cap 96 moves inward, the inside portion 144 thereof cooperates with the end portions 122 of the retainer collar fingers 118 to induce a radially inward flexing of the fingers 118. The flexing fingers 118 of the retainer collar 92 impress upon the arcuate blades 110 of the seizure pin 104 which in turn radially flex inward causing the interior surfaces 112 of the blades 110 to make contact around the surface of the center pin 34 for electrical contact and mechanical retainment therebetween. Once contact is achieved, any further application of compressive force is safely absorbed into the compressed compression ring 98 within the upper compression cap 100 without incurring damage to the connecting port assembly or the center pin 34 retained therein.

The connecting port assembly 60 of the present invention overcomes all of the limitations of the prior art connecting port assembly described above. In one aspect, the connecting port assembly 60 of the present invention avoids rigid retension of the center pin of a male coaxial cable connector, thus reducing structural and mechanical stress encountered during physical changes of the associated components whether induced by the material, temperature, the installer or other conditions. In addition, the connecting port assembly 60 is a self-adjusting device which provides sufficient contact pressure with the center pin 34 for an forming an excellent electrical connection therebetween thus avoiding the generation of the physical stress/strain to the components and the problems associate with cold flow. Furthermore, the seizure mechanism 72 provides a substantial contact area by encompassing a cylindrical portion of the center pin 34 for ensuring superior contact mating.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A connecting port assembly of an electrical device, said port assembly comprising:

a female port formed from a portion of a housing of said electrical device, said female port being configured for mechanical retainment and electrical connection with a coaxial cable connecting element through an opening therein;

a seizure member located within said female port, said seizure member having one end electrically coupled to electrical circuitry located in other portions of said housing, said seizure member being configured at another end for receiving, mechanically retaining and electrically contacting a center conductor or pin of said coaxial cable connecting element; and an actuating assembly being configured for effecting mechanical retainment and electrical contact of the seizure member to the center conductor or pin in response to advancement of an end portion of said coaxial cable connecting element into said female port during connection and retainment therebetween, said actuating assembly including a contact pressure restricter for limiting excessive contact pressure exerted by the seizure member on the center conductor or pin.

2. The connecting port assembly of claim 1, wherein said electrical device is a multi-tap.

3. The connecting port assembly of claim 1, wherein said female port includes internal screwthreads.

4. The connecting port assembly of claim 3, wherein the actuating assembly is configured for screw-threaded engagement with the internal screwthreads of said female port.

5. The connecting port assembly of claim 1, wherein said seizure member further comprises a metal shaft portion with a plurality of radially spaced arcuate blades extending longitudinally toward said port opening, said plurality of blades forming a central channel therebetween for receiving and contacting at least a portion of said center conductor when effected by said actuating assembly.

6. The connecting port assembly of claim 5, wherein said actuating assembly is disposed around said plurality of blades and configured to exert a circumferentially inward compressive force on said plurality of blades for effecting contact and retainment of the center conductor.

7. The connecting port assembly of claim 1, wherein the seizure member, the female port and the electrical device housing consist of an electrically conductive material.

8. The connecting port assembly of claim 7, wherein said electrically conductive material is selected from the group consisting of brass, copper, aluminum, and combinations thereof.

9. The connecting port assembly of claim 1, wherein the actuating assembly consists of electrically insulating material.

10. The connecting port assembly of claim 9, wherein the electrically insulating material is a plastic.

11. The connecting port assembly of claim 5, wherein said actuating assembly comprises:

a circular base portion located within said female port, includes a centrally located throughhole for permitting at least a portion of said plurality of arcuate blades therethrough, said base portion further includes a plurality of fingers with chamfered exterior end portions spaced radially around said plurality of blades and extending longitudinally towards said port opening;

a cylindrical carriage with a hollow core extending longitudinally therethrough and coupled to said circular base portion within said female port;

an annulus disposed within said carriage hollow core with an interior chamfered surface adapted for seating engagement with the chamfered exterior end portions of said plurality of fingers, wherein said plurality of fingers are configured to flex inward in response to movement of said annulus along the chamfered exterior finger end portions towards said base portion;

a C-shaped ring located within said carriage hollow core and seated on a recessed surface of the annulus opposite said base portion, said C-shaped ring includes a chamfered upper portion;

an annular cap located within said carriage hollow core and having a bottom end and a chamfered interior portion configured for seating engagement on said chamfered upper portion of said C-shaped ring, said annular cap further includes a flange portion extending along said bottom end; and a locking ring configured for fitting engagement with said carriage at one end of said through hole, said locking ring being further configured for operative retaining engagement with the flange portion of said annular cap within said carriage hollow core.

12. A connecting port assembly of an electrical device, said port assembly comprising:

an internally threaded female port formed from a portion of a housing of an electrical device, said female port being configured for threaded engagement with an externally threaded male coaxial cable connecting element;

a seizure pin located within said female port, said seizure pin including at one end a plurality of radially spaced-apart arcuate blades extending toward an opening of said female port, said blades being configured for therebetween receiving, mechanically retaining and electrically contacting a center conductor of said connecting element, and at another end being electrically connected to electrical circuitry located in other portions of said housing;

a collar assembly located around said plurality of blades within said female port, said collar assembly being configured to exert a radially inward compressive force around said plurality of blades for effecting contact and retainment by the plurality of blades with the center conductor in response to the advancement of an end portion of said connecting element into the female port; and means for adjusting said radially compressive pressure around said plurality of blades exerted by the collar assembly to prevent undesirable contact pressure on said center conductor.

13. The connecting port assembly of claim 12, wherein said collar assembly is threadably engaged with the internally threaded female port.

14. The connecting port assembly of claim 12, wherein said plurality of blades each further include an interior serrated surface.

15. The connecting port assembly of claim 12, wherein said electrical device is a multi-tap.

16. The connecting port assembly of claim 12, wherein said housing, female port, and seizure pin each consist of electrically conductive material.

17. The connecting port assembly of claim 12, wherein the collar assembly further consists of electrically insulating or non-conductive material.

18. A connecting port assembly of an electrical device, said port assembly comprising:

an internally threaded female port formed from a portion of a housing retaining electrical circuitry therein, said female port including an opening at a distal end and a cavity in communication with the opening;

a male connection pin seizure mechanism located within said port and electrically coupled to said electrical circuitry, said seizure mechanism including a female connector pin having a plurality of spaced-apart arcuate blades forming a cavity therebetween and extending longitudinally toward said port opening; and a collar assembly disposed around the exterior of said plurality of blades within said port, said collar assembly comprises:

a) a circular base portion located within said female port, including a centrally located throughhole for permitting at least a portion of each of said plurality of arcuate blades therethrough, said base portion further including a plurality of fingers with chamfered exterior end portions spaced radially around said plurality of blades and extending longitudinally towards said port opening;

b) a cylindrical carriage with a hollow core extending longitudinally therethrough and coupled to said circular base portion within said female port;

c) an annulus disposed within said carriage hollow core with an interior chamfered surface adapted for seating engagement with the chamfered exterior end portions of said plurality of fingers, wherein said plurality of fingers are configured to flex inward in response to movement of said annulus along the chamfered exterior finger end portions towards said base portion;

d) a C-shaped ring located within said carriage hollow core and seated on a recessed surface of the annulus opposite said base portion, said C-shaped ring includes a chamfered upper portion;

e) an annular cap located within said carriage hollow core and having a bottom end and a chamfered interior portion configured for seating engagement on said chamfered upper portion of said C-shaped ring, said annular cap further including a flange portion extending along said bottom end; and f) a locking ring configured for fitting engagement with said carriage at one end of said through hole, said locking ring being further configured for operative retaining engagement with flange portion of said annular cap within said carriage hollow core.

* * * * *